US005628208A

United States Patent [19]

Rood

[11] Patent Number: 5,628,208

[45] Date of Patent: May 13, 1997

[54] UNITARY RING REDUCER

[76] Inventor: Brenda Rood, 3513 Webster Subd., Valley City, N. Dak. 58072

[21] Appl. No.: 521,128

[22] Filed: Aug. 29, 1995

Related U.S. Application Data

[63] Continuation-in-part of Ser. No. 224,530, Apr. 7, 1994, abandoned.

[51] Int. Cl.[6] ..... A44C 9/02

[52] U.S. Cl. ..... 63/15.6; 63/15.5

[58] Field of Search ..... 63/15.6, 15.5, 63/15; D11/26–36

[56] References Cited

U.S. PATENT DOCUMENTS

| | | | |
|---|---|---|---|
| D. 178,743 | 9/1956 | Walley | 63/15.6 X |
| 3,465,544 | 9/1969 | Tucker | 63/15.6 |
| 4,538,430 | 9/1985 | Parks | 63/15.6 |
| 4,569,211 | 2/1986 | Lodrini | 63/15.6 |
| 5,261,256 | 11/1993 | Ellenbecker et al. | 63/15.6 |

*Primary Examiner*—Kien T. Nguyen

[57] ABSTRACT

A ring reducer for fitting a larger ring to an individual's smaller finger. The reducer includes a ring having a slot allowing a portion of a ring to be positioned within the conduit. A reducing web extends inward from the conduit to reduce the area of the ring and allow for the snug fit of a larger ring over a smaller finger. The reducer may be customized to a particular individual by trimming the reducing web with a knife.

7 Claims, 4 Drawing Sheets

10
12
24
28
26
20
30

22
26
16
30
14
3
10
32
28
24
20
3

FIG. 10
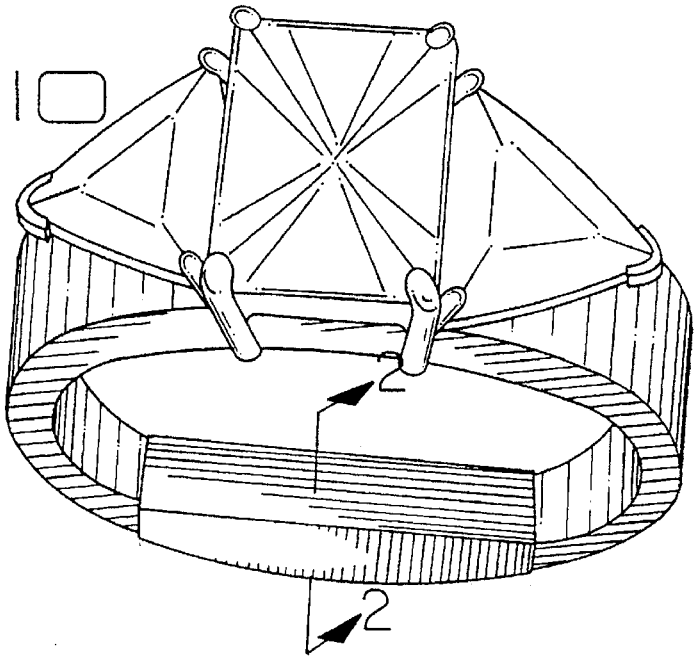
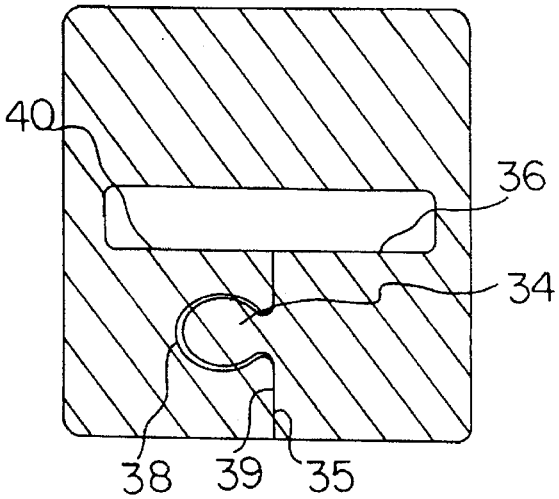
FIG. 5
FIG. 6
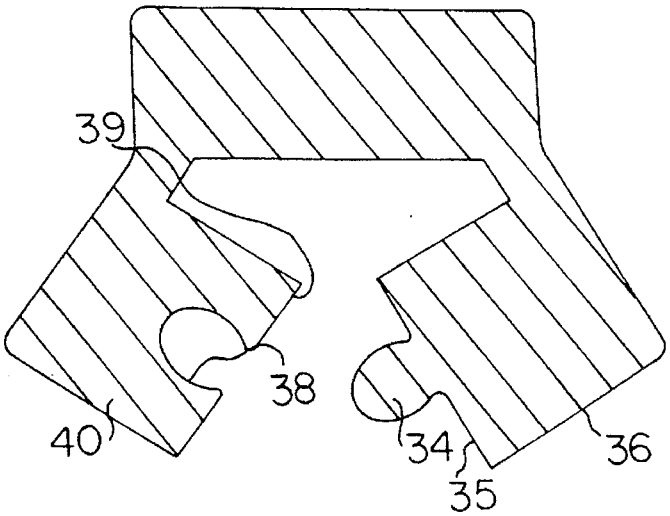

UNITARY RING REDUCER

RELATED APPLICATION

This application is a continuation-in-part for U.S. patent application Ser. No. 08/224,530 filed Apr. 7, 1994, now abandoned.

BACKGROUND OF THE INVENTION

1. Field of the Invention

The present invention relates to ring sizing devices and more particularly pertains to a unitary ring reducer for fitting a larger ring to a individual's smaller finger.

2. Description of the Prior Art

The use of ring sizing devices is known in the prior art. More specifically, ring sizing devices heretofore devised and utilized for the purpose of reducing the cross sectional area of a ring are known to consist basically of familiar, expected and obvious structural configurations, notwithstanding the myriad of designs encompassed by the crowded prior art which have been developed for the fulfillment of countless objectives and requirements.

For example, a finger ring and insert therefor is illustrated in U.S. Pat. No. 4,480,447 in which a saddle-shaped insert is fitted to the lower portion of a ring, with a leaf spring being provided between the ring and the insert to bias the insert radially inward. The insert preferably has depending tangs which can be bent around the outside edge of the ring to hold it in place.

Another patent of interest is U.S. Pat. No. 5,261,256 which teaches an instant flex ring guard or insert that is constructed of a soft flexible, low durometer thermoplastic rubber that will lay flat and affix to a bottom inside of a finger ring shank by means of adhesion. The device after installation remains flexible such that when a finger is inserted through the finger ring, the guard will flex out of the ring and then flex back into the finger ring when in position to constantly exert pressure against the finger keeping the ring from spinning on the finger.

Other known prior art ring sizing devices include U.S. Pat. No. 3,518,843; U.S. Pat. No. 4,916,924; U.S. Pat. No. 3,590,598; U.S. Pat. No. 3,237,426; U.S. Pat. No. 3,603,109; and U.S. Pat. No. 4,471,634.

While these devices fulfill their respective, particular objectives and requirements, the aforementioned patents do not disclose a unitary ring reducer for fitting a larger ring to an individual's smaller finger which includes a ring conduit having a slot allowing a portion of a ring to be positioned within the conduit and a reducing web extending radially inward from the conduit to reduce the area of the ring and allow for the snug fit of a larger ring over a smaller finger, wherein the reducer may be customized to a particular individual by trimming the reducing web with a knife.

SUMMARY OF THE INVENTION

In view of the foregoing disadvantages inherent in the known types of ring sizing devices now present in the prior art, the present invention provides an improved unitary ring reducer. As such, the general purpose of the present invention, which will be described subsequently in greater detail, is to provide a new and improved unitary ring reducer apparatus and method which has all the advantages of the prior art and none of the disadvantages.

To attain this, the present invention essentially comprises a ring reducer for fitting a larger ring to an individual's smaller finger. The reducer includes a ring conduit having a slot allowing a portion of a ring to be positioned within the conduit. A reducing web extends radially inward from the conduit to reduce the area of the ring and allow for the snug fit of a larger ring over a smaller finger. The reducer may be customized to a particular individual by trimming the reducing web with a knife.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved unitary ring reducer which has all the advantages of the prior art ring sizing devices and none of the disadvantages.

It is another object of the present invention to provide a new and improved unitary ring reducer which may be easily and efficiently manufactured and marketed.

It is a further object of the present invention to provide a new and improved unitary ring reducer which is of a durable and reliable construction.

An even further object of the present invention is to provide a new and improved unitary ring reducer which is susceptible of a low cost of manufacture with regard to both materials and labor, and which accordingly is then susceptible of low prices of sale to the consuming public, thereby making such ring sizing devices economically available to the buying public.

Still yet another object of the present invention is to provide a new and improved unitary ring reducer which provides in the apparatuses and methods of the prior art some of the advantages thereof, while simultaneously overcoming some of the disadvantages normally associated therewith.

Still another object of the present invention is to fit a larger ring to a individual's smaller finger.

Lastly, it is an object of the present invention to provide a new and improved ring reducer for fitting a larger ring to an individual's smaller finger. The reducer includes a ring having a slot allowing a portion of a ring to be positioned within the conduit. A reducing web extends inward from the conduit to reduce the area of the ring and allow for the snug fit of a larger ring over a smaller finger. The reducer may be customized to a particular individual by trimming the reducing web with a knife.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a second embodiment of the present invention shown in an engaged orientation.

FIG. 6 is the second embodiment of the present invention shown in a disengaged orientation.

FIG. 10 is an isomeric illustration of a ring utilizing the unitary ring reducer of the present invention.

Similar reference characters refer to similar parts throughout the several views of the drawings.

DESCRIPTION OF THE PREFERRED EMBODIMENT

Figure 1:
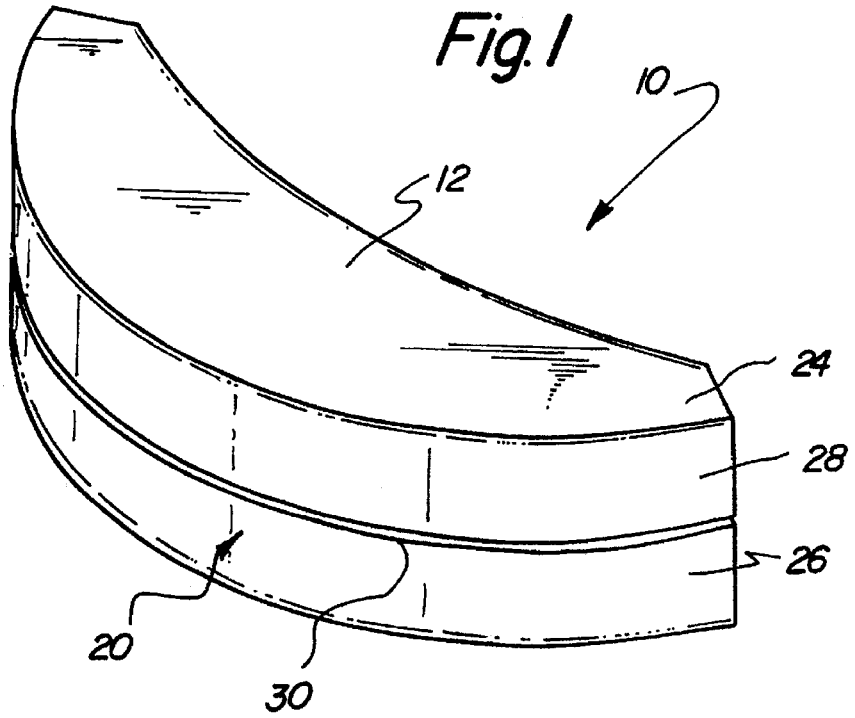
FIG. 1 is an isomeric illustration of a unitary ring reducer comprising the present invention.

With reference now to the drawings, and in particular to FIGS. 1–4 thereof, a new unitary ring reducer embodying the principles and concepts of the present invention and generally designated by the reference numeral 10 will be described.

Figure 3:
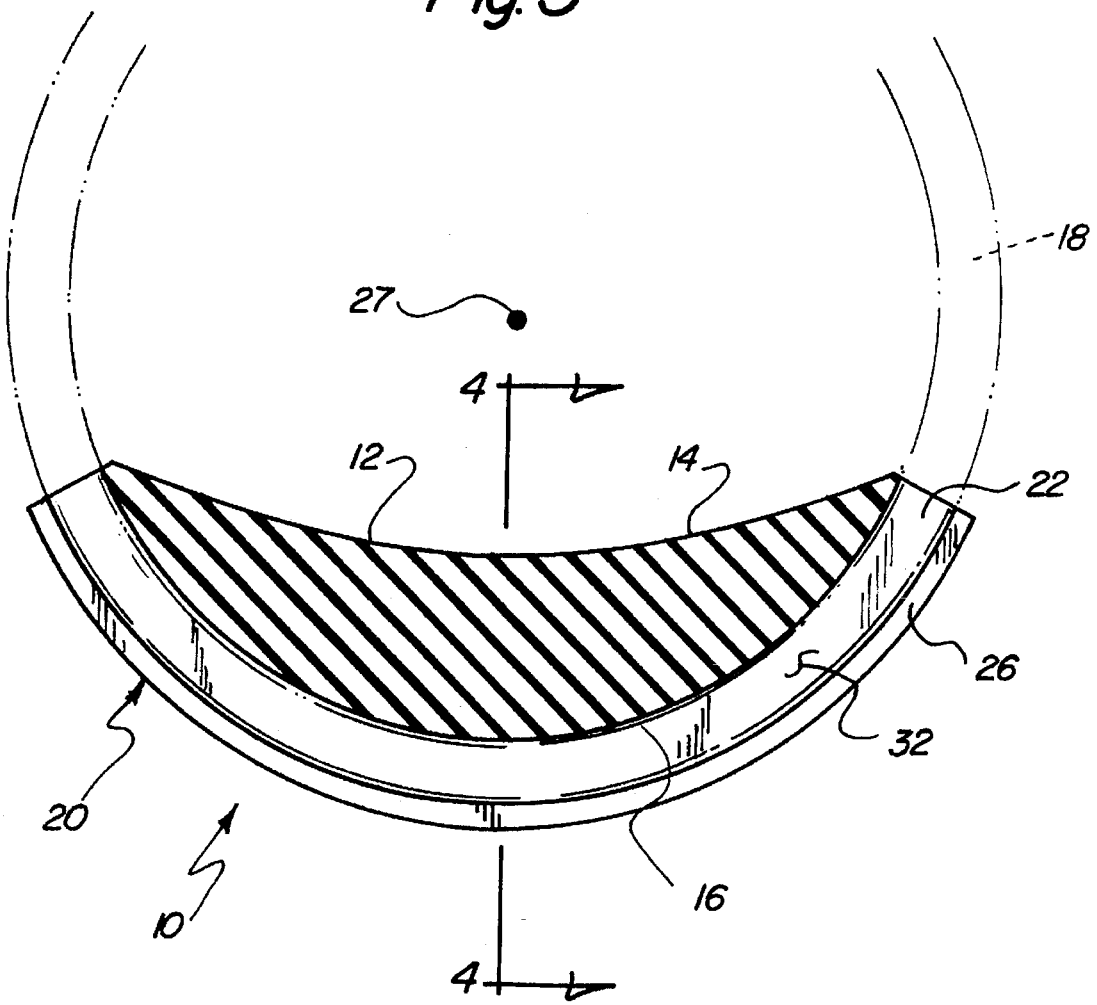
FIG. 3 is a cross sectional view taken along line 3—3 of FIG. 2.

More specifically, it will be noted that the unitary ring reducer 10 comprises a reducing web 12 having a substantially arcuate web face 14 having a first radius of curvature and a substantially arcuate web inner wall 16 having a second radius of curvature, wherein the first radius of curvature is greater than the second radius of curvature. The reducing web 12 is operable to be positioned against a lower inner surface of a ring 18, as illustrated in FIG. 3. Because the first radius of curvature of the web face 14 is greater than the second radius of curvature of the web inner wall 16, the reducing web necessarily projects radially inward to effectively reduce the through-cross-section of the ring 18, thereby allowing the ring to accommodate a smaller finger than would be possible without the ring reducer 10.

Figure 2:
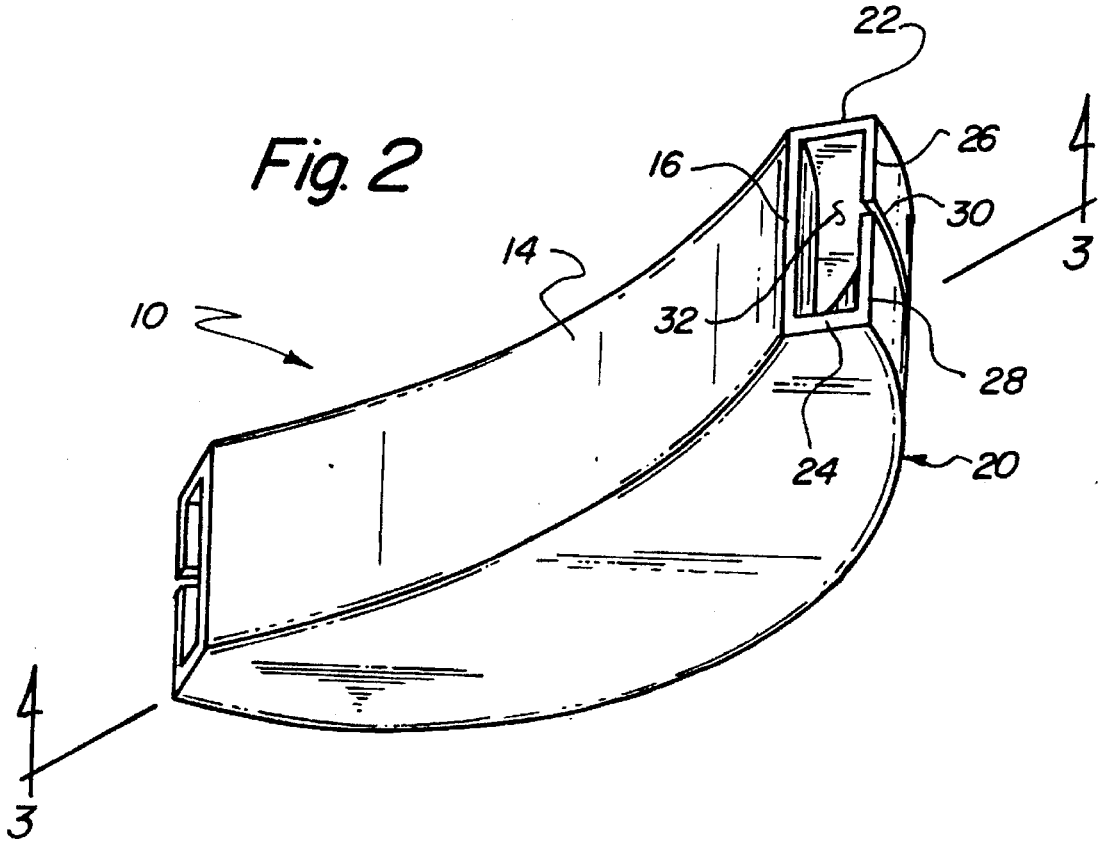
FIG. 2 is a further isometric illustration of the present invention.
Figure 4:
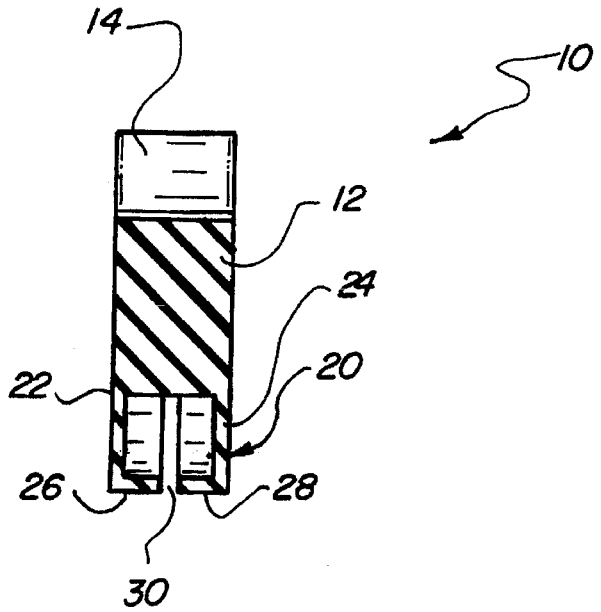
FIG. 4 is a cross sectional view taken along line 4—4 of FIG. 3.

To releasably couple the unitary ring reducer 10 to the ring 18, as illustrated in FIG. 3, a ring conduit 20 is provided. As best illustrated in FIGS. 2 and 4, it can be shown that the ring conduit 20 comprises a first side wall 22 and a second side wall 24 which are integrally formed with the reducing web 12 and extend radially outward from a center point 27 of the ring 18. Further, the side walls 22, 24 extend substantially parallel and coextensive relative one to the other, with the outer radial edges of the side walls being substantially arcuate in shape so as to follow the circular contour of the ring 18.

Integrally and orthogonally mounted to the respective side walls 22, 24 is a first outer wall 26 and a second outer wall 28. The outer walls 26, 28 extend laterally inward from the side walls 22, 24 to define a slot 30 coextensive with the outer walls. Thus, the inner web wall 16, the side walls 22 and 24, and the outer walls 26 and 28 cooperate to define a ring passage 32 within which a portion of the ring 18 may be captured, thereby mounting the reducing web 12 in the position illustrated in FIG. 3. The web 12 and the walls 22–28 are integrally formed of a substantially resilient polymeric material such that lateral deformation of the side walls in conjunction with radial deformation of the outer walls permits a portion of the ring 18 to be positioned within the ring passage 32, whereby the resiliency of the polymeric material will cause the walls to return to their original shape, in a shape retentive manner, to encapsulate and capture the portion of the ring within the passage 32.

In use, the unitary ring reducer 10 may be easily attached to a ring 18 as described above, thereby reducing the through-cross-sectional area of the ring to accommodate smaller fingers. In addition, the reducing web 12, because of its polymeric construction, may be trimmed with a knife or other sharp instrument to alter a contour of the web face 14 and provide a customized fit to a particular individual.

A second embodiment, as shown in FIG. 5 & 6, comprises a spherical horizontally extending protrusion 34 formed along an end 35 of a first outer wall 36. Also included is a spherical inlet 38 formed along an end 39 of a second outer wall 40 for releasably receiving the spherical protrusion 34.

Figure 7:
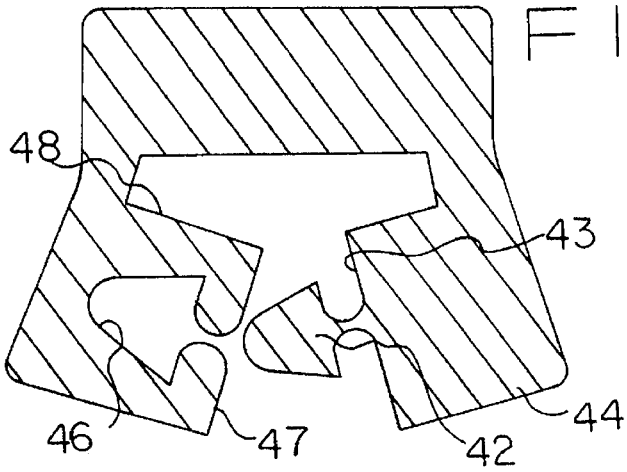
FIG. 7 is a third embodiment of the present invention.

A third embodiment, as shown in FIG. 7, comprises a triangular horizontally extending protrusion 42 formed along an end 43 of a first outer wall 44. Also included is a triangular inlet 46 horizontally formed along an end 47 of a second outer wall 48 for releasably receiving the triangular protrusion 42.

Figure 8:
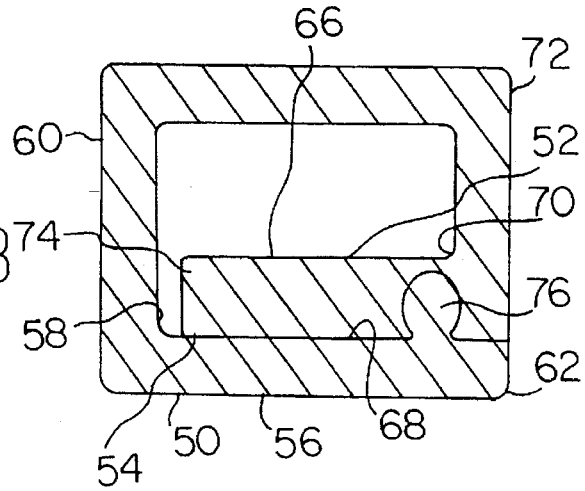
FIG. 8 is a fourth embodiment of the present invention.

A fourth embodiment, as shown in FIG. 8, comprises a first outer wall 50 overlapping a second outer wall 52. The first outer wall 50 comprises an upper surface 54, lower surface 56, an inboard end 58 connected to one side wall 60 and a free outboard end 62. The second outer wall 52 of the ring reducer comprises an upper surface 66, lower surface 68, an inboard end 70 connected to another side wall 72 and a free outboard end 74. The fourth embodiment further includes a circular protrusion 76 formed along the upper surface 54 of the outboard end 62 of the first wall 50. For coupling purposes, an inlet 78 is formed along the lower surface 68 of the inboard end 70 of the second outer wall 64 for releasably receiving the circular protrusion 76.

Figure 9:
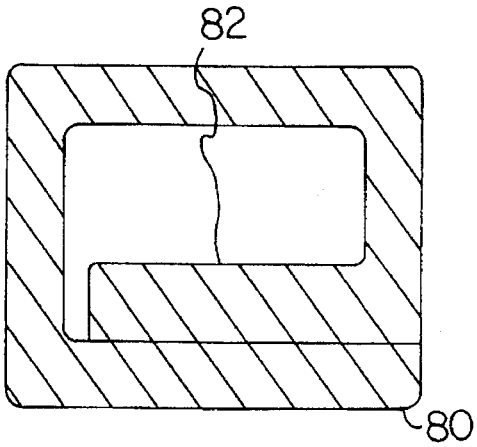
FIG. 9 is a fifth embodiment of the present invention.

A fifth embodiment, as shown in FIG. 9, is constructed similar to the fourth embodiment with a first outer wall 80 overlapping a second outer wall 82 while lacking the protrusion and corresponding inlet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new unitary ring reducer comprising:

a reducing web having a substantially arcuate web face of a first radius of curvature, and a substantially arcuate web inner wall of a second radius of curvature, wherein said first radius of curvature is greater than said second radius of curvature, said reducing web being positionable against a lower inner surface portion of a ring such that said reducing web projects radially inward to reduce a through-cross-section of said ring;

a ring conduit means coextensive with said reducing web for retaining said reducing web to said ring; said ring conduit means comprising a first side wall spaced from a second side wall, said side walls being integrally formed with and coextensive with said reducing web, said side walls having outer radial edges of substantially arcuate shape so as to follow a circular contour of said ring, said ring conduit means further comprising a first outer wall and a second outer wall, with said outer walls extending laterally inward from respective first and second side walls to define a thin arcuate slot coextensive of said ring conduit means and oriented between said outer walls, whereby said inner web wall, said side walls, and said outer walls cooperate to define a ring passage within which said portion of said ring is captured to mount said reducing web to said ring; and, wherein said web and said walls are integrally formed of a substantially resilient shape retentive material such that lateral deformation of said side walls in conjunction with radial deformation of said outer walls permits said portion of said ring to be positioned within said passage, whereby a resiliency of said polymeric material will cause said walls to return to an original shape to encapsulate and capture said portion of said ring within said passage.

2. A new unitary ring reducer comprising:

a reducing web positionable against a lower inner surface portion of a ring such that said reducing web projects inward to reduce a through-cross-section of said ring;

a ring conduit means coextensive with said reducing web for retaining said reducing web to said ring; said ring conduit means comprising a first side wall spaced from a second side wall, said side walls being integrally formed with and coextensive with said reducing web, said side walls having outer radial edges of substantially arcuate shape so as to follow a circular contour of said ring, said ring conduit means further comprising a first outer wall and a second outer wall, with said outer walls extending laterally inward from respective first and second side walls, whereby said inner web wall, said side walls, and said outer walls cooperate to define a ring passage within which said portion of said ring is captured to mount said reducing web to said ring; and, coupling means for allowing the web to be secured to said portion of said ring;

wherein said web and said walls are integrally formed of a substantially resilient shape retentive material such that lateral deformation of said side walls in conjunction with radial deformation of said outer walls permits said portion of said ring to be positioned within said passage, whereby a resiliency of said polymeric material will cause said walls to return to an original shape to encapsulate and capture said portion of said ring within said passage.

3. A new unitary ring reducer as set forth in claim 2 wherein said coupling means comprises:

a spherical protrusion formed along an end of the first outer wall; and a spherical inlet formed along an end of the second outer wall for releasably receiving the spherical protrusion.

4. A new unitary ring reducer as set forth in claim 2 wherein said coupling means comprises:

a triangular protrusion formed along an end of the first outer wall; and a triangular inlet formed along an end of the second outer wall for releasably receiving the triangular protrusion.

5. A new unitary ring reducer as set forth in claim 2 wherein said coupling means comprises the first outer wall overlapping said second outer wall.

6. A new unitary ring reducer as set forth in claim 5 wherein the first outer wall comprises an upper surface, a lower surface, an inboard end connected to the first side wall and a free outboard end; the second outer wall of the ring reducer comprises an upper surface, a lower surface, an inboard end connected to the second side wall and a free outboard end and the ring reducer further comprising:

a protrusion formed along the upper surface of the outboard end of the first outer wall; and an inlet formed along the lower surface of the inboard end of the second outer wall for releasably receiving the triangular protrusion.

7. A new unitary ring reducer comprising:

a reducing web positionable against a lower inner surface portion of a ring such that said reducing web projects inward to reduce a through-cross-section of said ring;

a ring conduit means retaining said reducing web to said ring; and coupling means for allowing the web to be secured to said portion of said ring, the coupling means including a protrusion and an associated inlet;

wherein said reducing web is formed of a trimmable material such that said reducing web can be trimmed with a sharp instrument to alter a contour of said web face.

* * * * *